US005938432A

United States Patent [19]

Heinrich et al.

[11] Patent Number: 5,938,432

[45] Date of Patent: Aug. 17, 1999

[54] TOP CLOSING DEVICE FOR SHAFT FURNACES

[75] Inventors: Peter Heinrich, Geldern; Hartmut Hille, Moers; Werner Otremba, Oberhausen; Marco Ricke, Coesfeld, all of Germany

[73] Assignee: SMS Schloemann-Siemag Aktiengesellschaft, Dusseldorf, Germany

[21] Appl. No.: 09/034,475

[22] Filed: Mar. 4, 1998

[30] Foreign Application Priority Data

Mar. 7, 1997 [DE] Germany ..... 197 09 329

[51] Int. Cl.[6] ..... C21B 7/08; C21B 7/18; F27D 3/10

[52] U.S. Cl. ..... 432/95; 414/203; 266/184

[58] Field of Search ..... 432/95, 96, 101; 414/203; 266/184

[56] References Cited

FOREIGN PATENT DOCUMENTS 2404647 8/1974 Germany .
2035458 6/1978 Germany .
2065460 12/1978 Germany .
3632724 12/1988 Germany .

*Primary Examiner*—Teresa Walberg
*Assistant Examiner*—Gregory A. Wilson
*Attorney, Agent, or Firm*—Friedrich Kueffner

[57] ABSTRACT

A top closing device for shaft furnaces, particularly blast furnaces, including an inlet hopper with inlet pipe, a rotating, vertically non-adjustable chute carrier with rotary drive, a pivotable chute in the furnace interior with external drive means, and sealing members between the rotating and stationary components. The rotating chute carrier is mounted with a gear ring attached to a flange in a ball bearing slewing rim arranged on a catch basket. The rotary movement of the rotating chute carrier is effected outside of the furnace space by an electric motor drive with pinion. The catch basket is arranged on the furnace support ring of the gas seal hood. The pivoting or tilting movement of the chute relative to the furnace axis within the rotating chute carrier is effected by a hydraulic or electromechanical drive outside of the furnace space. An annular sealing member for sealing relative to the rotating chute carrier is mounted on the furnace support ring next to the flange of the catch basket. An annular sealing member for sealing relative to the stationary inlet pipe is mounted on the inner flange of the chute carrier.

14 Claims, 3 Drawing Sheets

TOP CLOSING DEVICE FOR SHAFT FURNACES

BACKGROUND OF THE INVENTION

1. Field of the Invention

The present invention relates to a top closing device for shaft furnaces, particularly blast furnaces, including an inlet hopper with inlet pipe, a rotating, vertically non-adjustable chute carrier with rotary drive, a pivotable chute in the furnace interior with external drive means, and sealing members between the rotating and stationary components.

2. Description of the Related Art

For filling and distributing the charges for charging shaft furnaces, devices have long been known which are constructed in accordance with the so-called McKee principal. In this construction, which is a gas seal bell, a small bell is arranged in the upper portion and a large bell is arranged in the lower portion. The upper of the bells or funnels arranged one above the other is rotatable.

An improvement of the McKee closing device is a conventional construction in which the lower large bell does not have to form a gas-tight closure because the rotary distributor closed by the bell is arranged in a tightly closed sleeve.

In another improvement according DE 36 32 724 C2, the problem of sealing between the lower distributor bell and the lower lock chamber is negligible because the upper funnel is constructed as a pressure-tight closeable lock chamber with the use of a stationary hood equipped with charging flaps.

DE OS 24 04 647 discloses a device for driving or moving a device for charging a blast furnace with raw materials, wherein a distribution channel is connected to the lower ends of an inner cylinder and an outer cylinder, wherein the inner cylinder and the outer cylinder are mounted so as to be rotatable together, are displaceable axially relative to each to each other and are supported independently of each other. The distribution channel is additionally rotatable together with the inner cylinder and the outer cylinder and is tiltable relative to the outer cylinder and the inner cylinder with the vertical movement of the inner cylinder or the outer cylinder.

The distribution channel interacts with drive means arranged at the outer side of the blast furnace, with an electric drive for the inner cylinder and with a hydraulic drive for lifting and lowering the outer cylinder.

The inner cylinder or the outer cylinder has a flange resting on a support means, wherein the outer cylinder or the inner cylinder is supported by a gear ring. A sealing means is provided between the inner cylinder and the outer cylinder.

DE-AS 10 13 681 discloses a sealing device at rotatable top closing devices of blast furnaces with a pressure ring fastened at the rotary hopper and a corresponding stationary annular sealing mass, wherein the sealing of pressure ring and sealing mass is effected by the force of a spring.

Readjustable springs are arranged in an annular housing fastened in a gas-tight manner on the upper bell, wherein the readjustable springs continuously press the annular sealing mass against the slip ring which rotates with the rotary hopper. The contact pressure of the springs is variably adjustable by means of a tightening device composed of a readjustable tightening screw.

In other known charging devices for blast furnaces in accordance with DE 20 35 458, DE 20 65 460, etc. which are operated with counterpressure at the opening, a stationary, central material inlet is provided through which the burden drops onto a rotatable chute. The rotary bearing and the drive components of the chute are located in the furnace space.

The charging device described last has also been improved in various ways. For example, the rotary bearing and drive components of the chute were arranged in their own housing which was separate from the remaining furnace space. The circulation gas inlet leads into this housing. The purpose of this is to prevent the hot and dust-containing blast furnace gases from entering.

SUMMARY OF THE INVENTION

Therefore, it is the primary object of the present invention to improve a top closing device for shaft furnaces without a bell in such a way that the device has a structural height which is as low as possible and the construction of the device is simple, well organized and easy to maintain, wherein, in particular, the drives for the rotating and tilting movements of the chute carrier and of the chute are not in connection with the furnace space.

In accordance with a first embodiment of the present invention, the rotating chute carrier is mounted with a gear ring attached to a flange in a ball bearing slewing rim arranged on a catch basket. The rotary movement of the rotating chute carrier is effected outside of the furnace space by an electric motor drive with pinion. The catch basket is arranged on the furnace support ring of the gas seal hood. The pivoting or tilting movement of the chute relative to the furnace axis within the rotating chute carrier is effected by a hydraulic or electromechanical drive outside of the furnace space. An annular sealing member for sealing relative to the rotating chute carrier is mounted on the furnace support ring next to the flange of the catch basket. An annular sealing member for sealing relative to the stationary inlet pipe is mounted on the inner flange of the chute carrier.

In the top closing device according to the first embodiment of the present invention, wherein the material inlet hopper with the inlet pipe are arranged underneath the lock bunkers, the chute carrier arranged underneath the inlet pipe rotates together with the tiltable chute which protrudes into the gas seal hood of the furnace. The structural height of the chute carrier is low and the drives for the rotary movement of the chute carrier with the chute and for the tilting movement of the chute which are arranged spatially separate from each other extend within the vertical dimension of the chute carrier and are arranged completely outside of the furnace space.

Both drives operate completely independently of each other. The rotary drive for the chute carrier is preferably composed of a gear ring and pinion driven by an electric motor. However, if necessary, other types of drives can be used.

The drive for effecting the tilting movements of the chute may be a hydraulic drive, an electromechanical drive or a mechanical drive.

Since the rotary and tilting drives are installed outside of the furnace space, they operate under atmospheric pressure.

In contrast to the superimposed rotating and tilting movements in the chute drives according to the prior art, in the chute carrier with chute according to the present invention these movements are separated into an exclusively rotary movement and an exclusively tilting movement.

Mechanical seals are used for sealing the rotating chute carrier relative to the stationary inlet pipe of the material inlet hopper. Special coal ring seals have been found particularly useful for this purpose.

In accordance with a second embodiment of the present invention, the rotating chute carrier is mounted with a gear ring attached to a flange in a ball bearing slewing rim arranged on a catch basket. The rotary movement of the rotating chute carrier is effected outside of the furnace space by an electric motor drive with pinion. The catch basket is arranged on the furnace support ring of the gas seal hood. The pivoting or tilting movement of the chute relative to the furnace axis within the rotating chute carrier is effected by a hydraulic or electromechanical drive outside of the furnace space. An annular sealing member for sealing relative to the rotating chute carrier is mounted on the furnace support ring next to the flange of the catch basket. The inner flange of the rotating chute carrier is non-detachably connected to the inlet pipe. The inlet pipe is detachably connected to the material inlet hopper, and the material inlet hopper is sealed relative to the stationary outlet of the lock bunker by an annular sealing member.

Accordingly, in the second embodiment of the top closing device according to the present invention, not only the chute carrier with chute are rotating, but also the lock pipe connected to the chute carrier as well as the material inlet hopper there above.

In this embodiment, sealing relative to the stationary outlet of the lock bunker and the rotating material inlet hopper with subsequently arranged lock pipe is effected by mechanical seals which are mounted at the outlet of the lock bunker.

Damaged or worn chutes can be disassembled or removed either upwardly or to the side. When the chute is disassembled upwardly, initially the mechanical seals between the rotating chute carrier and the stationary inlet pipe are removed. Then the cover with manhole within the chute carrier is removed. The chute is then secured by a suitable device and subsequently the connection of the chute to the material inlet hopper is separated. Finally, the tilting drive for the chute is separated, the inlet pipe is removed and the chute is disassembled.

The disassembly or removal of the chute toward the side takes place through a closeable opening in the gas seal hood of the furnace.

In order to protect the chute carrier against the influence of heat, the bottom of the chute carrier is advantageously provided with a cooling unit. Water or another suitable liquid may be the cooling medium. Particularly advantageous is a forced cooling. Of course, when it is considered necessary, the cooling device may also extend over the inner wall of the chute carrier.

Instead of providing the aforementioned cooling device, the interior of the chute carrier can also be provided partially or completely with a thermal protection, for example, by guniting with refractory material.

In addition, the heat influence can be shielded upwardly by means of a funnel-shaped temperature protection device arranged underneath the chute carrier. This temperature protection device rotates together with the chute carrier and includes a slot for the tiltable chute.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
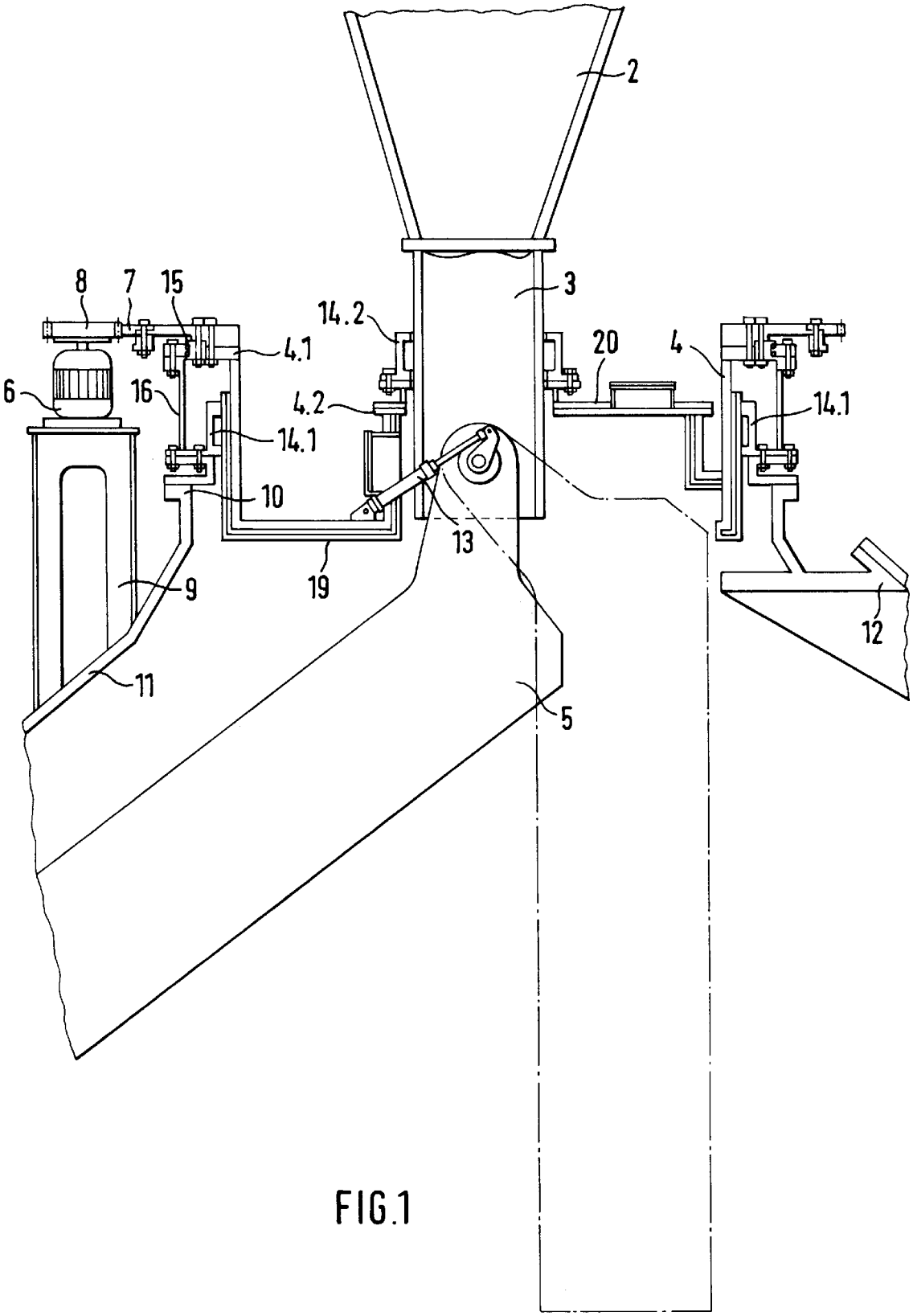
FIG. 1 is a schematic side view of a first embodiment of a top closing device according to the present invention, particularly showing the chute carrier and chute.
Figure 2:
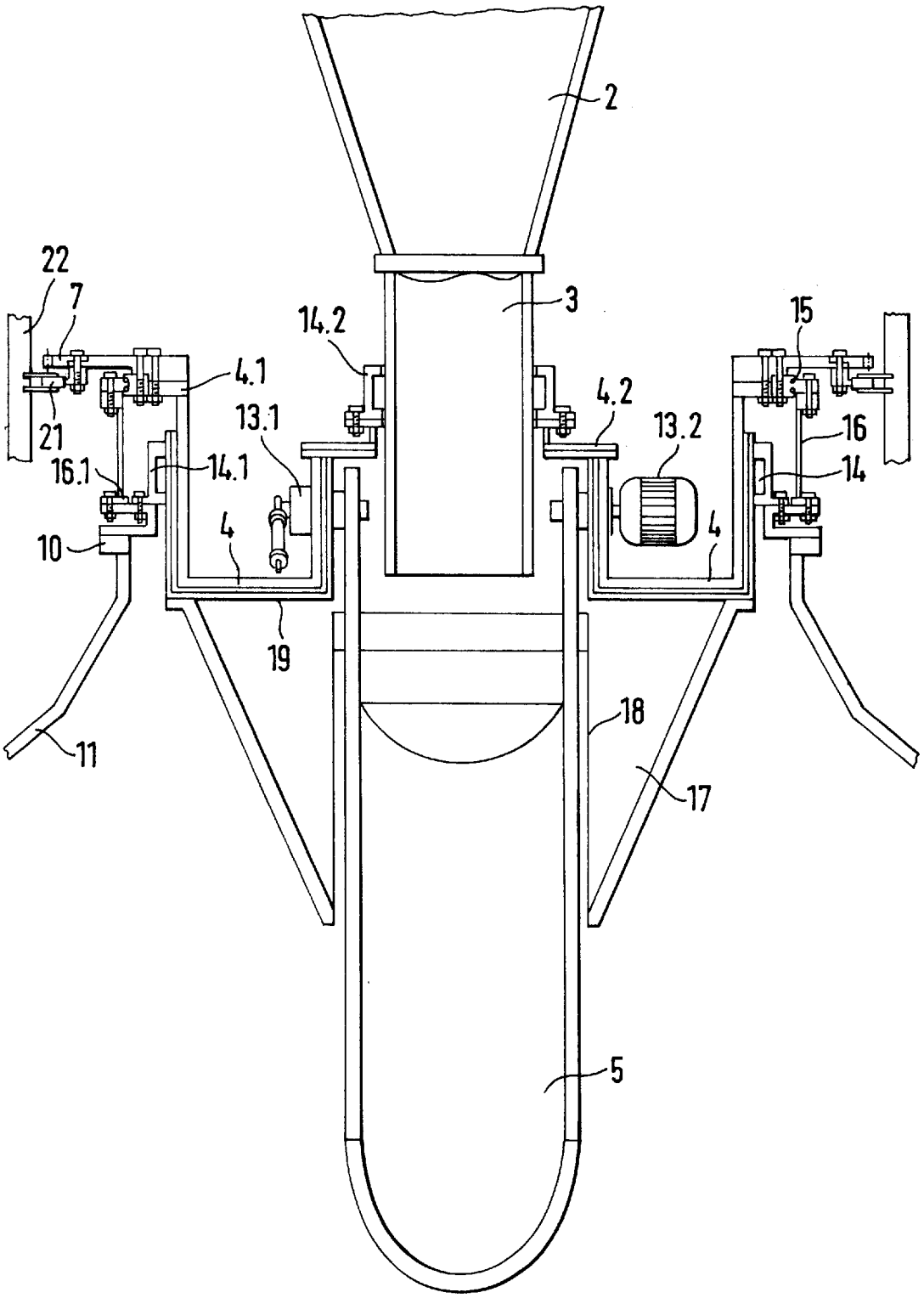
FIG. 2 is a front view of the embodiment of FIG. 1.

FIGS. 1 and 2 of the drawing show the first embodiment of the top closing device according to the present invention.

The chute carrier 4 rotates with the chute 5, while the inlet pipe 3 with the material inlet funnel 2, not shown, are stationary.

Figure 3:
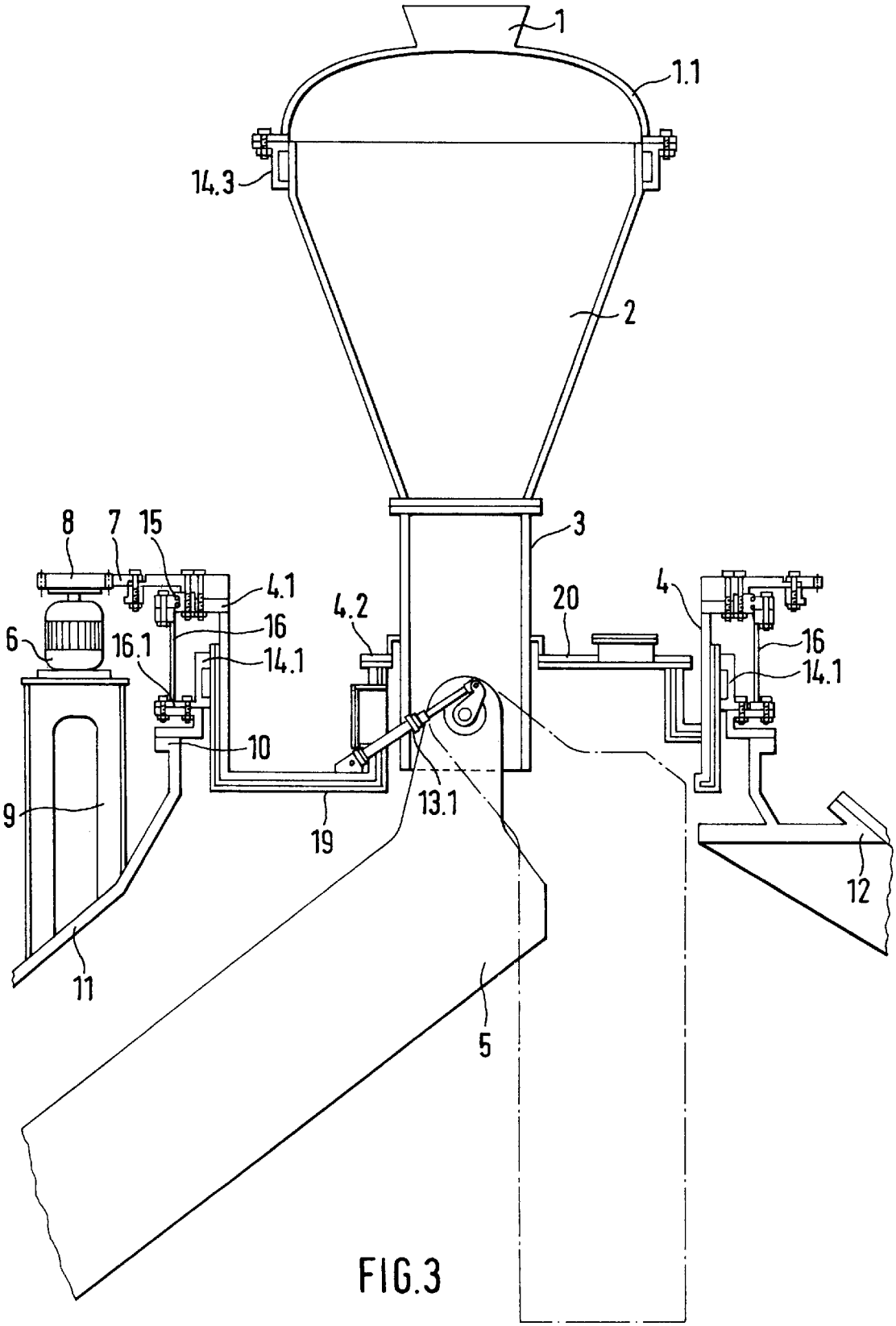
FIG. 3 is a side view of another embodiment of the top closing device according to the present invention.

FIG. 3 shows a different embodiment of the top closing device. In this case, in addition to the chute carrier 4 with chute 5, the inlet pipe 3 and the material inlet hopper 2 also rotate. In this embodiment, the mechanical seals 14.3 between the material inlet hopper and the lock bunker 1 are arranged at the outlet 1.1.

In accordance with FIGS. 1 and 2, the burden for charging the blast furnace is dropped from a lock bunker, not shown, into a material inlet hopper 2 arranged underneath the bunker.

From the material inlet hopper 2, the burden is introduced through the inlet pipe 3 onto a tiltable and rotatable chute 5 arranged within the chute carrier 4 and reaches the upper portion of the blast furnace from the chute 5.

The chute carrier with chute 5 mounted in a ball bearing slewing rim 15 is rotated by a drive system composed of pinion 8, gear ring 7 and electric motor 6. The entire drive system 6, 7, 8 for the chute carrier is mounted on a bracket 9 which rests on the gas seal hood 11 of the blast furnace.

The hydraulic tilting drive 13.1 or the electric tilting drive 13.2 for carrying out the tilting movements of the chute 5 relative to the blast furnace axis is located within the chute carrier 4 outside of the furnace shaft.

FIG. 1 of the drawing shows the chute 5 in the inclined position in solid lines and in the vertical end position in broken lines.

The sealing members for sealing the blast furnace in the region of the rotating chute carrier 4 relative to the stationary inlet pipe 3 are provided with reference numeral 14.2, the sealing members between the rotating chute carrier and the stationary furnace support ring 10 are provided with reference numeral 14.1.

The ball bearing slewing rims and the flange 4.1 of the chute carrier 4 are mounted on support baskets 16.

For compensating any lateral movements of the chute carrier 4, guide rollers 21 are arranged on columns 22, which rest on the gas seal hood 11.

In addition, guide rollers resting on the chute carrier can be arranged on the circumference of the inlet pipe 3 for compensating any movements.

As shown on the right hand side of FIG. 1, a manhole with cover 20 is arranged within the chute carrier 4.

The chute carrier 4 has on the inside and at least at the bottom thereof a cooling device 19.

In the front view of FIG. 2, the temperature protection device 17 mounted on the bottom of the chute carrier 4 is visible. Also provided is a slot 18 in the temperature protection device 17 which permits pivoting of the chute 5.

Finally, FIG. 1 shows a closeable opening 12 through which, if necessary, a damaged or worn chute 5 can be disassembled.

FIG. 3 of the drawing shows the second embodiment of the present invention.

In this second embodiment, the inlet pipe 3 and the material inlet hopper 2 arranged above the inlet pipe 3 rotate together with the chute carrier 4 and the tiltable chute 5 about the axis of the furnace.

Sealing of the rotating material inlet hopper 2 relative to the stationary outlet 1.1 of the lock bunker 1 is effected by an annular sealing member 14.3 mounted on the stationary outlet 1.1.

Sealing of the rotating chute carrier 4 is effected by an annular sealing ring 14.1 which is arranged on the furnace support ring 10 of the gas seal hood 10 next to the flange 16.1 of the catch basket 16.

Also in this embodiment, the rotating chute carrier 4 is fastened with a flange 4.1 to a gear ring 7 which, in turn, is mounted in a ball bearing slewing rim mounted on the catch basket 16.

The rotary movement of the rotating chute carrier 4 is effected outside of the furnace space by an electric motor drive 6 with pinion 8.

The catch basket 16 is detachably mounted on the flange of the furnace support ring 10 of the gas seal hood 11. The pivoting or tilting movement of the chute 5 relative to the furnace axis within the rotating chute carrier 4 is effected by a hydraulic drive 13.1 or electromechanical drive 13.2 outside of the furnace space.

While specific embodiments of the invention have been shown and described in detail to illustrate the inventive principles, it will be understood that the invention may be embodied otherwise without departing from such principles.

We claim:

1. A top closing device for shaft furnaces, particularly blast furnaces, comprising a material inlet hopper with inlet pipe, a rotating, vertically non-adjustable chute carrier with rotary drive mounted underneath the inlet pipe, a pivotable chute mounted in a furnace interior attached to the chute carrier, the chute having external drive means, further comprising sealing members between rotating and stationary components, wherein the rotating chute carrier is mounted with a gear ring attached to a flange in a ball bearing slewing rim arranged on a catch basket, wherein the rotary movement of the rotating chute carrier is effected outside of the furnace interior by an electric motor drive with pinion, wherein the catch basket is mounted on a furnace support ring of a gas seal hood, wherein the pivoting or tilting movement of the chute relative to a furnace axis within the rotating chute carrier is effected by a hydraulic or electromechanical drive outside of the furnace interior, wherein an annular sealing member for sealing relative to the rotating chute carrier is mounted on the furnace support ring next to the flange, and wherein an annular sealing member for sealing relative to the stationary inlet pipe is mounted on an inner flange of the chute carrier.

2. The top closing device according to claim 1, wherein the rotating chute carrier and the stationary inlet pipe are configured for permitting disassembly of the chute in an upward direction.

3. The top closing device according to claim 1, wherein the gas seal hood has a closeable opening for laterally disassembling the chute.

4. The top closing device according to claim 1, further comprising a funnel-shaped temperature protection device mounted underneath the rotating chute carrier, the temperature protection device being mounted so as to rotate with the rotating chute carrier and having a slot for the chute.

5. The top closing device according to claim 1, wherein the annular sealing members are comprised of carbon sealing rings.

6. The top closing device according to claim 1, wherein the rotating chute carrier is provided at least at a bottom thereof and at least on an inside or an outside thereof with at least one of a cooling device and a thermal protective device.

7. The top closing device according to claim 6, wherein the cooling device comprises a forced cooling system.

8. A top closing device for shaft furnaces, particularly blast furnaces, comprising a material inlet hopper with inlet pipe, a rotating, vertically non-adjustable chute carrier with rotary drive mounted underneath the inlet pipe, a pivotable chute mounted in a furnace interior attached to the chute carrier, the chute having external drive means, further comprising sealing members between rotating and stationary components, wherein the rotating chute carrier is mounted with a gear ring attached to a flange in a ball bearing slewing rim arranged on a catch basket, wherein the rotary movement of the rotating chute carrier is effected outside of the furnace interior by an electric motor drive with pinion, wherein the catch basket is mounted on a furnace support ring of a gas seal hood, wherein the pivoting or tilting movement of the chute relative to a furnace axis within the rotating chute carrier is effected by a hydraulic or electromechanical drive outside of the furnace interior, wherein an annular sealing member for sealing relative to the rotating chute carrier is mounted on the furnace support ring next to the flange, wherein the inner flange of the rotating chute carrier is non-detachably connected to the inlet pipe, wherein the inlet pipe is detachably connected to the material inlet hopper, and wherein sealing of the material inlet hopper relative to a stationary outlet of a lock bunker is effected by an annular sealing member.

9. The top closing device according to claim 8, wherein the rotating chute carrier and the inlet pipe rotating with the chute carrier are configured for permitting disassembly of the chute in an upward direction.

10. The top closing device according to claim 8, wherein the gas seal hood has a closeable opening for laterally disassembling the chute.

11. The top closing device according to claim 8, further comprising a funnel-shaped temperature protection device mounted underneath the rotating chute carrier, the temperature protection device being mounted so as to rotate with the rotating chute carrier and having a slot for the chute.

12. The top closing device according to claim 8, wherein the annular sealing members are comprised of carbon sealing rings.

13. The top closing device according to claim 8, wherein the rotating chute carrier is provided at least at a bottom thereof and at least on an inside or an outside thereof with at least one of a cooling device and a thermal protective device.

14. The top closing device according to claim 13, wherein the cooling device comprises a forced cooling system.

* * * * *